US008421685B2

(12) United States Patent
Su et al.

(10) Patent No.: US 8,421,685 B2
(45) Date of Patent: Apr. 16, 2013

(54) SPATIAL FILTER FOR NEAR FIELD MODIFICATION IN A WIRELESS COMMUNICATION DEVICE

(75) Inventors: Xiaomeng Su, San Diego, CA (US); Ting Ting Dong, Shanghai (CN); Sebastian Rowson, San Diego, CA (US); Jeffrey Shamblin, San Marcos, CA (US); Laurent Desclos, San Diego, CA (US)

(73) Assignee: Ethertronics, Inc., San Diego, CA (US)

( * ) Notice: Subject to any disclaimer, the term of this patent is extended or adjusted under 35 U.S.C. 154(b) by 399 days.

(21) Appl. No.: 12/776,322

(22) Filed: May 7, 2010

(65) Prior Publication Data

US 2010/0283691 A1 Nov. 11, 2010

Related U.S. Application Data

(60) Provisional application No. 61/176,435, filed on May 7, 2009.

(51) Int. Cl.
*H01Q 1/24* (2006.01)

(52) U.S. Cl.
USPC ..... 343/702; 343/700 MS

(58) Field of Classification Search ..... 343/702, 343/700 MS, 846
See application file for complete search history.

(56) References Cited

U.S. PATENT DOCUMENTS

| | | | | |
|---|---|---|---|---|
| 2003/0179143 | A1* | 9/2003 | Iwai et al. | 343/702 |
| 2005/0024275 | A1* | 2/2005 | Jo et al. | 343/702 |
| 2005/0168383 | A1* | 8/2005 | Lee | 343/700 MS |
| 2006/0017624 | A1* | 1/2006 | Nagano et al. | 343/702 |

* cited by examiner

*Primary Examiner* — Hoanganh Le
(74) *Attorney, Agent, or Firm* — Coastal Patent Agency; Joshua Schoonover

(57) ABSTRACT

A spatial filter is developed for specific absorption rate (SAR) reduction in a wireless device. A conductive element is designed to modify the near field distribution of an antenna operating in a wireless device. This reduces SAR while minimizing degradation of antenna efficiency at one or several frequency bands that the antenna is designed to operate over. Lumped reactance can be designed into the conductive element to generate low pass, band pass, and/or high pass frequency characteristics. Distributed reactance can be designed into the conductive element to replace or to work in conjunction with the lumped reactance. Active components can be designed into the conductive element to provide dynamic tuning of the frequency response of the conductive element.

15 Claims, 10 Drawing Sheets

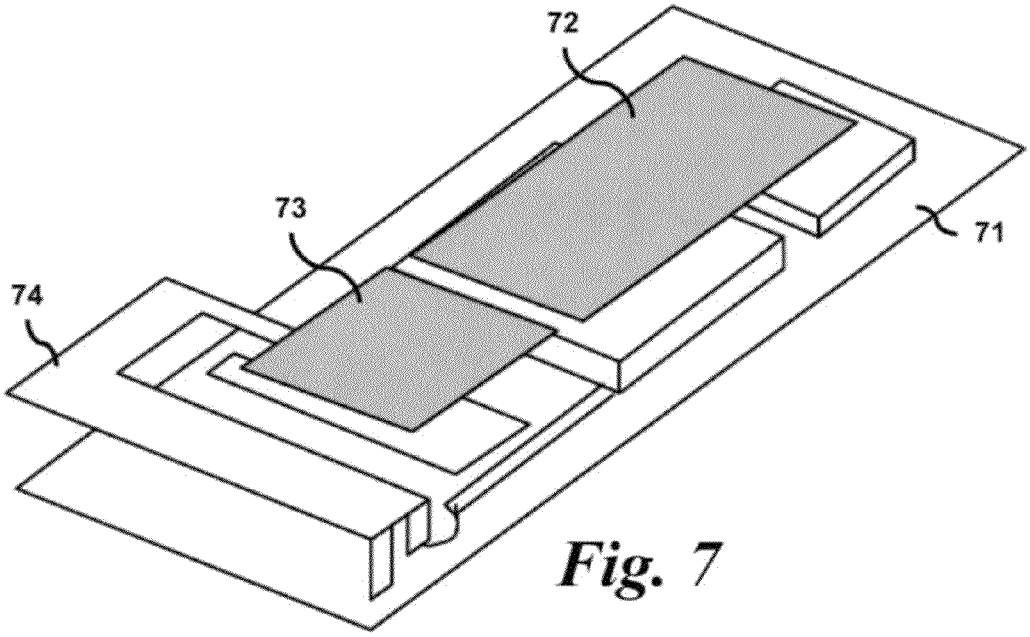
Fig. 7
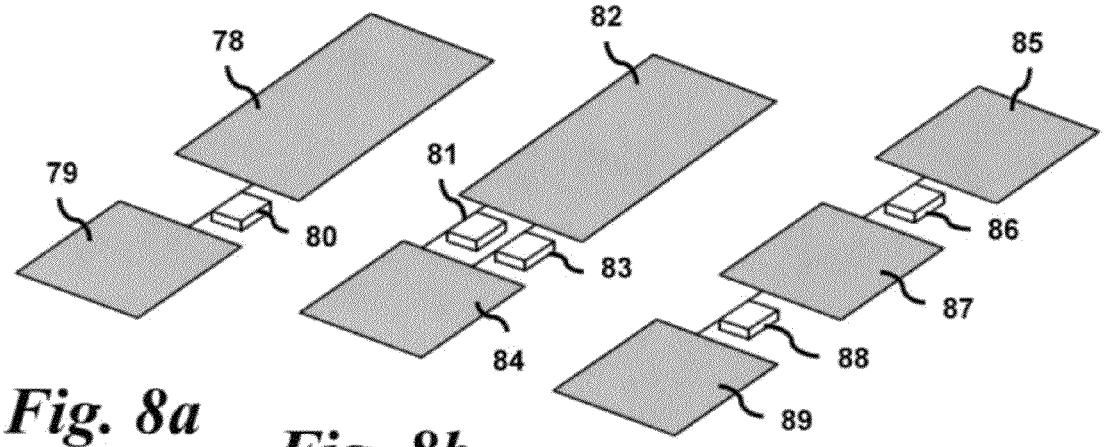
Fig. 8a
Fig. 8b
Fig. 8c

SPATIAL FILTER FOR NEAR FIELD MODIFICATION IN A WIRELESS COMMUNICATION DEVICE

FIELD OF INVENTION

The present invention relates generally to the field of wireless communication. In particular, the present invention relates to an antenna system for use within such wireless communication.

BACKGROUND OF THE INVENTION

A wide range of electrical requirements must be met by antennas in wireless devices. These requirements include TRP (total radiated power), TIS (total isotropic sensitivity), efficiency, and SAR (specific absorption rate). The TRP is a measure of the radiation efficiency of an antenna; the SAR is a measure of the density of the near-field field strength as measured in human tissue adjacent to the antenna enabled device. An improvement in SAR, which is a reduction in SAR value, typically coincides with reduced radiating efficiency. It is highly desirable to develop methods to reduce SAR without impacting antenna radiating efficiency.

An antenna positioned on a small to moderate sized wireless device such as a cell phone, laptop, USB dongle, or data card excites the circuit board and other components of the wireless device. The near field electromagnetic field distribution and far field radiation pattern characteristics are affected by the characteristics of the wireless device.

In order to achieve good efficiency and SAR from an internal antenna, techniques need to be developed to reduce the amount of near field coupling of the antenna to the user while maintaining good antenna efficiency. This can be achieved by modifying the near field of the combination of the antenna and wireless device by spreading the regions of peak electric and magnetic field strength over a larger volume. This approach reduces the electromagnetic field strength per unit volume in the near field of the wireless device. If the near field distribution can be spread over a larger volume without reducing antenna efficiency then the desired outcome is achieved.

SUMMARY OF THE INVENTION

A technique has been developed to spread the near field radiated characteristics of an antenna on a small wireless device without significantly altering the far field antenna characteristics such as but not limited to, gain and efficiency.

In one aspect of the present invention a conductive element is positioned in close proximity to a wireless device that contains an antenna. The conductive element is dimensioned and shaped to alter the electromagnetic field of the antenna on the wireless device in such a way as to reduce the maxima and/or cause spreading of the near field distribution. The efficiency of the radiated far field of the antenna is monitored and optimized during the design process of the conductive element such that the near field distribution is altered to provide reduced SAR with minimal impact on radiated efficiency.

In an embodiment of the invention, distributed reactance can be designed into the conductive element and adjusted to alter the frequency response of the conductive element by spacing slotted portions at variable distances, shaping or otherwise physically altering physical characteristics of the conductive element, and similar design alternatives. The distributed reactance can be implemented in such a way as to reduce the frequency of operation of the conductive element, provide a band-pass response, or to provide low or high pass responses in terms of the frequency response of the conductive element. The distributed reactance can be adjusted to improve SAR performance at a range of frequencies while providing minimal disturbance to antenna efficiency at another range of frequencies. Alternately, lumped reactance components can be designed into the conductive element to provide the reactance to alter the frequency response of the conductive element. Lumped reactance components, or lumped components, include capacitance and inductance features lumped into a functional reactance component for use in electronics, such as an LC lumped component.

In another embodiment of the invention, a conductive element is configured to connect various portions of the circuit board of the wireless device. The electrical length of the conductive element can be adjusted to alter the near field distribution of the antenna operating on the wireless device. The conductive element can be separated into two or more portions and reconnected using components to adjust the frequency response. Multiple conductive elements can be connected to various locations on the circuit board of the wireless device to provide additional flexibility in terms of modifying the near field distribution.

BRIEF DESCRIPTION OF THE DRAWINGS

These and other attributes of the invention are further described in the following detailed description, particularly when reviewed in conjunction with the drawings, wherein:

FIG. 7 illustrates the conductive element separated into two portions to adjust the frequency response of the element.

FIG. 8 illustrates lumped components used to connect portions of the conductive element. The types and value of components used to connect the portions of the conductive element can be chosen to generate filters to alter the frequency response of the conductive element.

DETAILED DESCRIPTION OF THE PREFERRED EMBODIMENTS

In the following description, for purposes of explanation and not limitation, details and descriptions are set forth in order to provide a thorough understanding of the present invention. However, it will be apparent to those skilled in the art that the present invention may be practiced in other embodiments that depart from these details and descriptions.

Embodiments of the present invention provide for a conductive element that is dimensioned, shaped, and positioned in the vicinity of a wireless device and the antenna on the wireless device. The conductive element is designed to alter the electromagnetic field to reduce the maxima and/or cause a spreading of the field distribution in the near field of the device. The conductive element can be disconnected and then re-joined using lumped components to provide filtering in the frequency domain. Distributed reactance can be designed into the conductive element to provide filtering, and both lumped components and distributed reactance can be incorporated in the same conductive element. Active components can be coupled across portions of the conductive element to provide a dynamically tuned response to adjust the frequency response of the conductive element. Active components include capacitors, switches, varicap or varactor diodes, and the like.

A plurality of conductive elements can be used to reduce and/or modify the near field electromagnetic field distribution. This can be achieved by stacking multiple conductive elements or positioning multiple elements in a side by side arrangement. A plurality of conductive elements can be incorporated in a single design by both stacking and by arrangement in a side by side configuration. The conductive elements used in a single design can contain lumped components, distributed reactance, and active components for dynamic frequency tuning.

Figure 1:
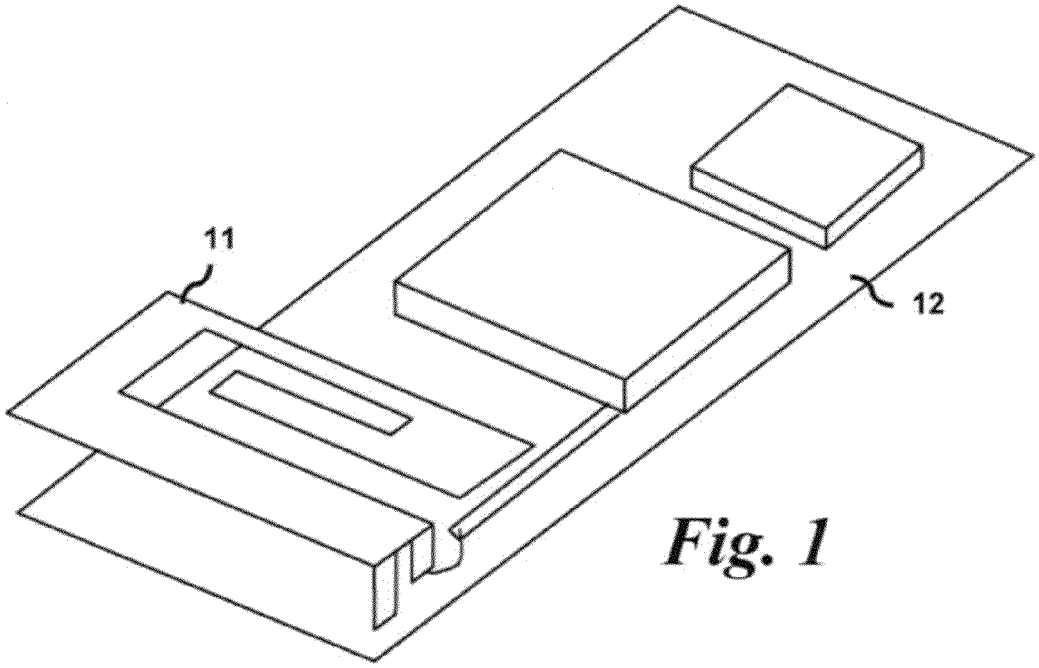
FIG. 1 illustrates an antenna installed on the circuit board of a wireless device.

FIG. 1 illustrates an antenna 11 attached to the circuit board 12 of a wireless device.

Figure 2:
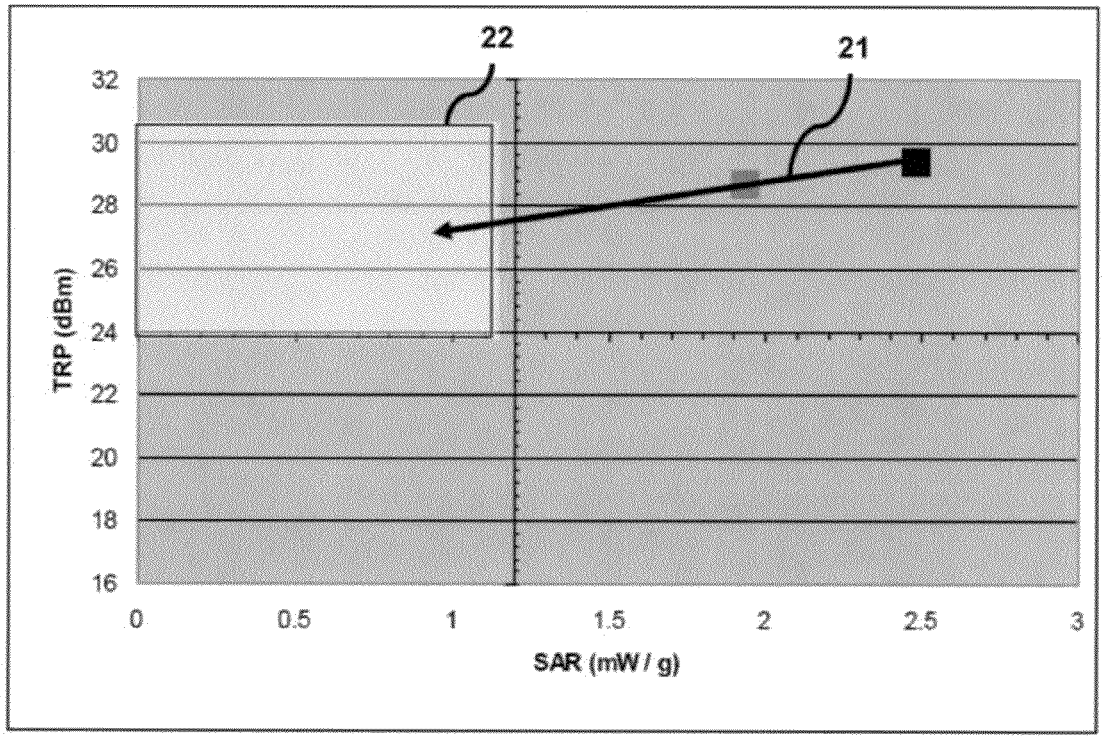
FIG. 2 illustrates a plot of the TRP (Total Radiated Power) and SAR (Specific Absorption Rate) of an antenna in a wireless device. The arrow illustrates a desired movement of the TRP/SAR metric to the left upper quadrant of the graph. This region maps the high TRP and low SAR region, which is the desired attributes for the antenna.

FIG. 2 is a plot of the TRP (Total Radiated Power) and SAR (Specific Absorption Rate) of an antenna in a wireless device. The arrow 21 illustrates a desired movement of the TRP/SAR metric to the left upper quadrant 22 of the graph. This region maps the high TRP and low SAR region, which is the desired attributes for the antenna.

Figure 3:
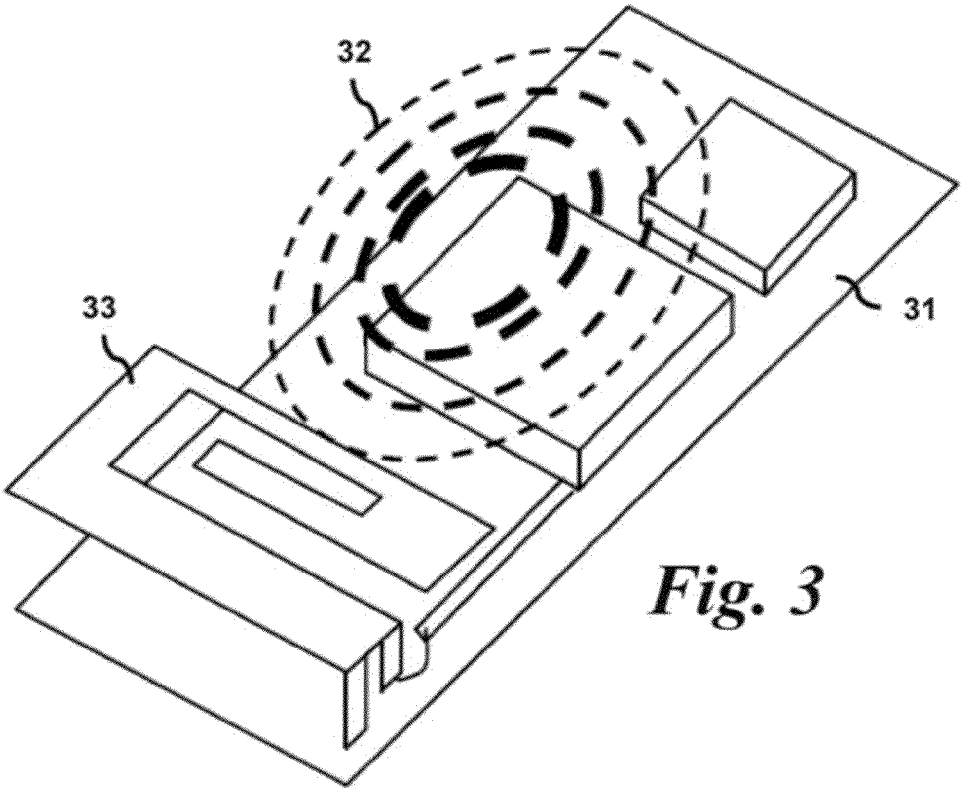
FIG. 3 illustrates a contour plot of the electromagnetic field in the near field of the wireless device. The field maxima is quite often not positioned directly above the antenna, but instead is positioned at other locations above the device, and is dependent on device size, frequency of operation, and other factors.

FIG. 3 illustrates an antenna 33 attached to the circuit board 31 of a wireless device, and further illustrates a contour plot of the electromagnetic field 32.

Figure 4:
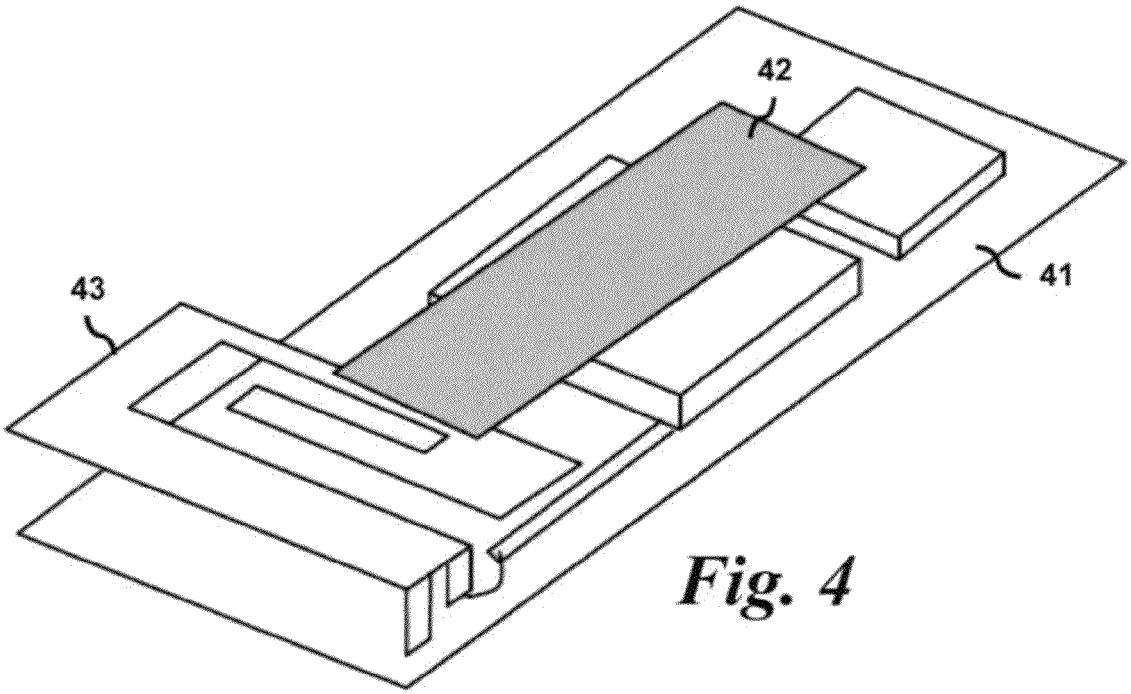
FIG. 4 illustrates a conductive element positioned in close proximity to the wireless device.

FIG. 4 illustrates a conductive element 42 positioned in proximity to a wireless device antenna 43 positioned above a ground plane 41.

Figure 5:
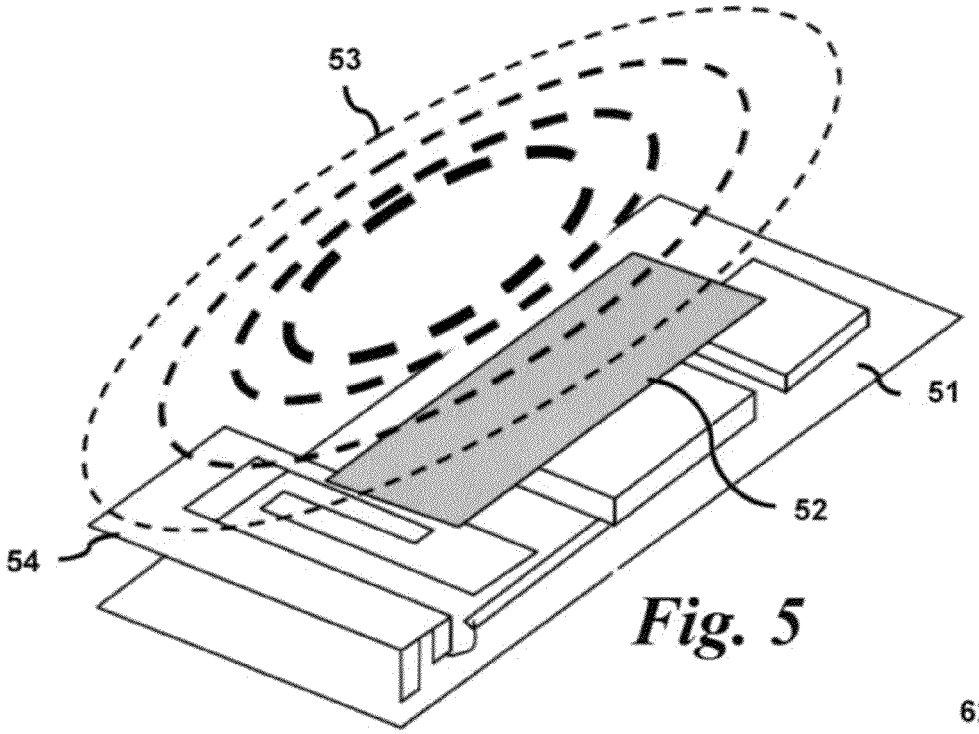
FIG. 5 illustrates a contour plot of the electromagnetic field in the near field of the wireless device with the conductive element positioned close to the device. The field maxima is reduced in value compared to the contour plot shown in FIG. 3. The field distribution represented by the contour plot is spread over a larger volume.

FIG. 5 illustrates a contour plot of the electromagnetic field 53 of a wireless device 51 with a conductive element 52 in close proximity. An antenna 54 is located in proximity with the conductive element 52. The field distribution has spread over a larger volume compared to the field distribution in FIG. 3, resulting in reduced field maxima for a set volume. This will result in reduced SAR for the wireless device; and therefore improvements associated with a reduced SAR in the wireless communication device are provided. The conductive element couples to the antenna element for distributing the electromagnetic field over a large volume, i.e. the circuit board and attached electronic components.

Figure 6:
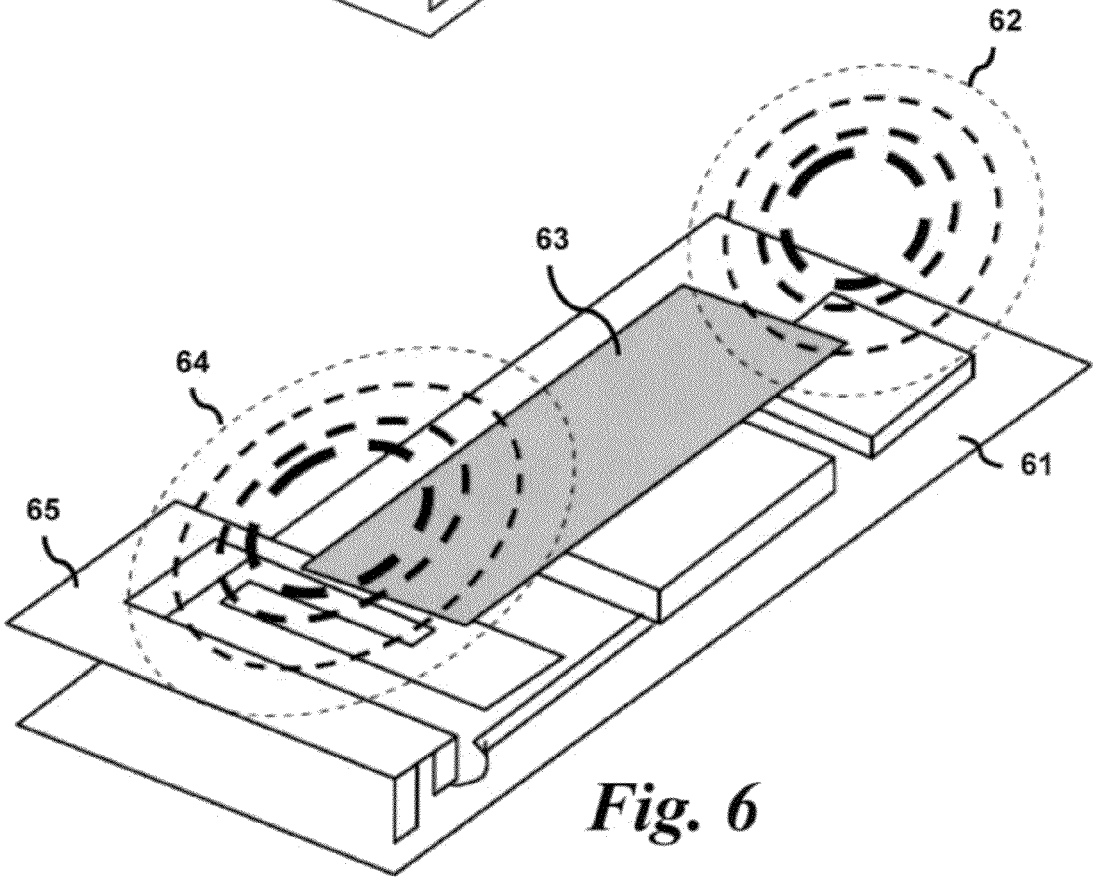
FIG. 6 illustrates another contour plot of the electromagnetic field in the near field of the wireless device with a conductive element positioned close to the device. The field distribution is broken into two field maxima separated in distance at different locations of the wireless device. This type of field distribution can be achieved by design of the conductive element.
Figure 9A:
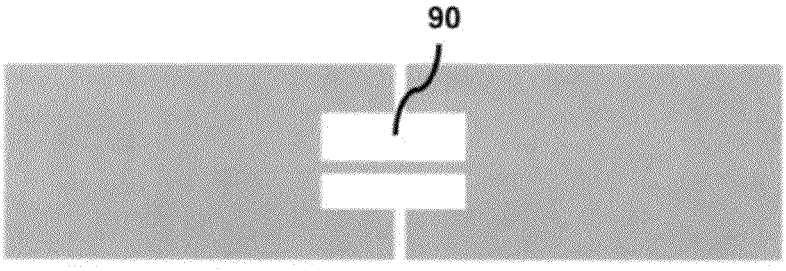
FIG. 9 illustrates several types of conductive elements with distributed reactance incorporated into the element. The distributed reactance can be adjusted to alter the frequency response of the conductive element.
Figure 9B:
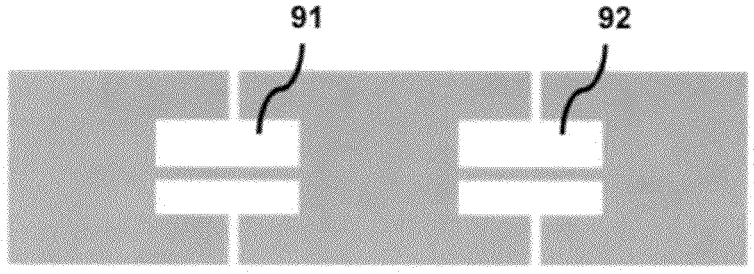
Figure 9C:
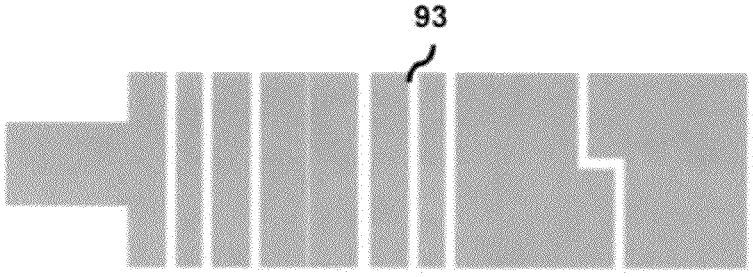
Figure 9D:
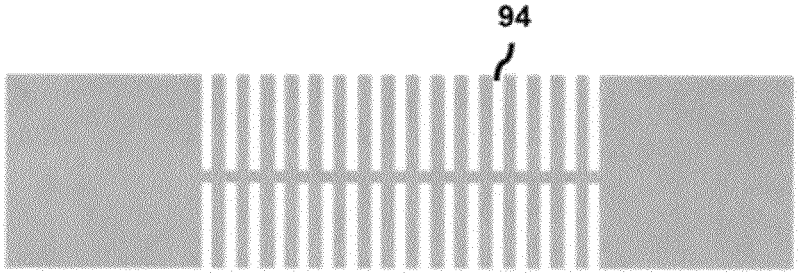
Figure 9E:
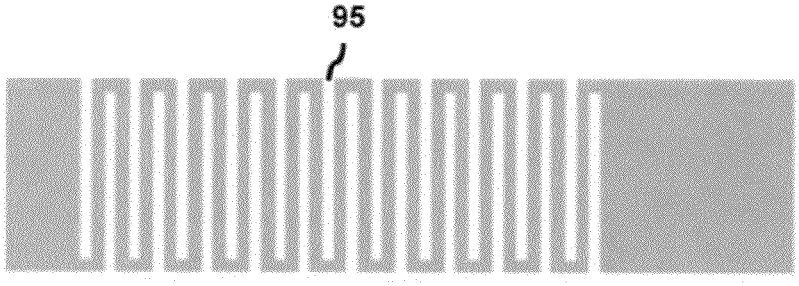

FIG. 6 illustrates an alternate contour plot of the electromagnetic field 62; 64 in the near field of the wireless device 61 with a conductive element 63 positioned close to the device. The field distribution is broken into two field maxima separated in distance at different locations of the wireless device. This type of field distribution can be achieved by design of the conductive element. An antenna 65 is located near the conductive element 63.

The physical design characteristics of the conductive element can be configured to improve the function of the antenna. FIG. 7 illustrates a conductive element separated into a first portion 72 and a second portion 73 to adjust the frequency response of the element. Second portion 73 is positioned in proximity to an antenna element 74. The spacing between second portion 73 and the antenna along with the dimensions of second portion 73 can be adjusted to couple more or less between the antenna and second portion 73, and can be adjusted to couple varying amounts at different frequencies. Similarly, design characteristics of first portion 72, such as size, shape, thickness, and space between coupling regions, can be configured to vary the attributes of the antenna fields.

FIG. 8 illustrates a lumped component 80 used to connect the portions 78 and 79 of the conductive element. In a similar embodiment, two lumped components 81; 83 form a resonant circuit and are used to connect two portions 82; 84 of a conductive element. In yet another similar embodiment, two sets of lumped components 86 and 88 are used to connect three portions of a conductive element 85; 87; 89 to provide additional filtering and control of the frequency response. The types and value of components used to connect the portions of the conductive element can be chosen to generate filters to alter the frequency response of the conductive element.

FIG. 9 illustrates several types of conductive elements with distributed reactance regions incorporated into the element. The distributed reactance can be adjusted to alter the frequency response of the conductive element. In one embodiment as illustrated in FIG. 9*a*, a distributed LC section 90 is designed into a conductive element. FIG. 9*b* illustrates two distributed LC sections 91 and 92 are designed into a single conductive element. FIG. 9*c* illustrates a series of capacitive sections formed by coupling regions 93 designed into a conductive element. In a similar embodiment, a method to reduce the frequency of operation is illustrated in FIG. 9*d*, wherein the design 94 includes a plurality of slots incorporated into a conductive element. The distributed reactance can include a capacitive or inductive reactance generated from the designed structure. In FIG. 9*e*, another method of applying a distributed LC circuit is shown in pattern 95 containing a plurality of coils distributed along a length of the conductive element. A distributed reactance region may include a combination of capacitive sections, and inductive sections. Additionally, the distributed reactance region can be configured to function as a low pass, or high pass component section, or collectively herein referred to as a filter component.

Figure 10A:
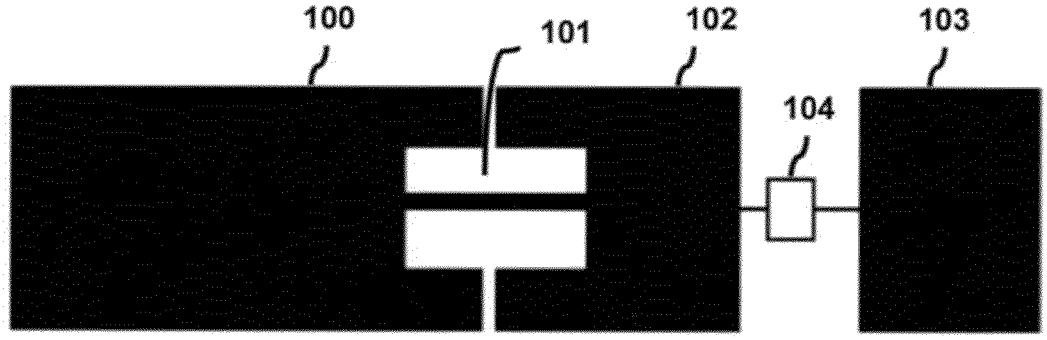
FIG. 10 illustrates examples of a conductive element with a combination of lumped and distributed reactance incorporated into the element, an active component connecting two portions of the conductive element, and multiple conductive elements stacked to provide additional control of the frequency response.
Figure 10B:
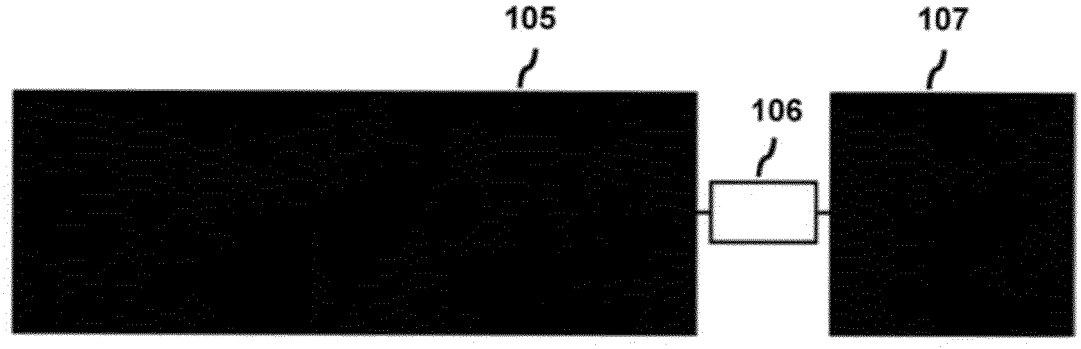
Figure 10C:
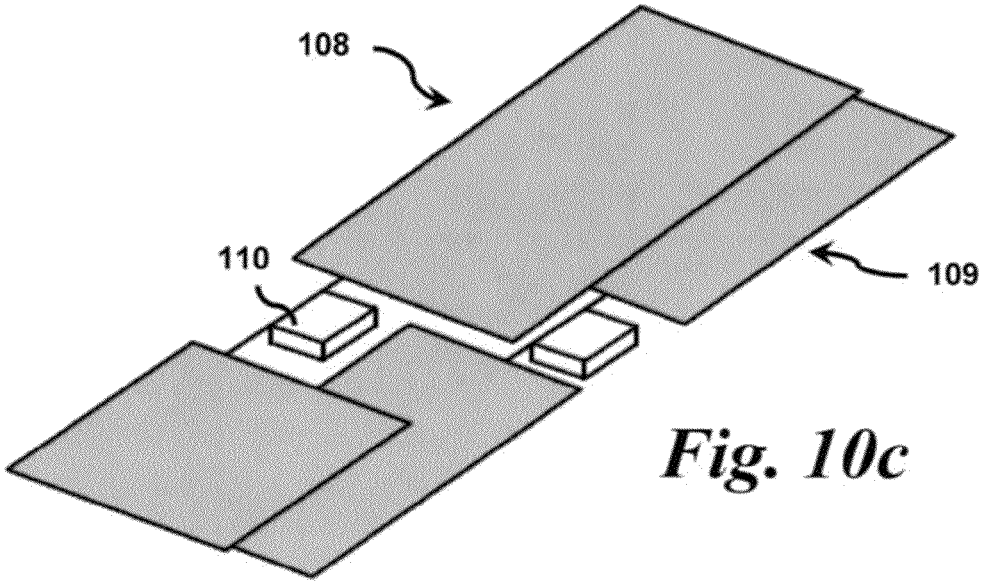

FIG. 10*a* illustrates a conductive element with a combination of lumped 104 and distributed reactance 101 incorporated into a conductive element. The conductive element may further include a first portion 100, a second portion 102, and a connection therebetween. In FIG. 10*b*, an active component 106 is used to connect first and second portions 105; 107 of the conductive element to provide dynamic tuning of the conductive element. In an alternative embodiment as illustrated in FIG. 10*c*, two conductive elements 108 and 109 are stacked to provide additional control of the frequency response. The first portion can be connected to the second portion by at least one of: an inductor, capacitor, resistor, diode, transistor, RF switch, tunable capacitor, and mechanical switch, or the like.

Figure 11:
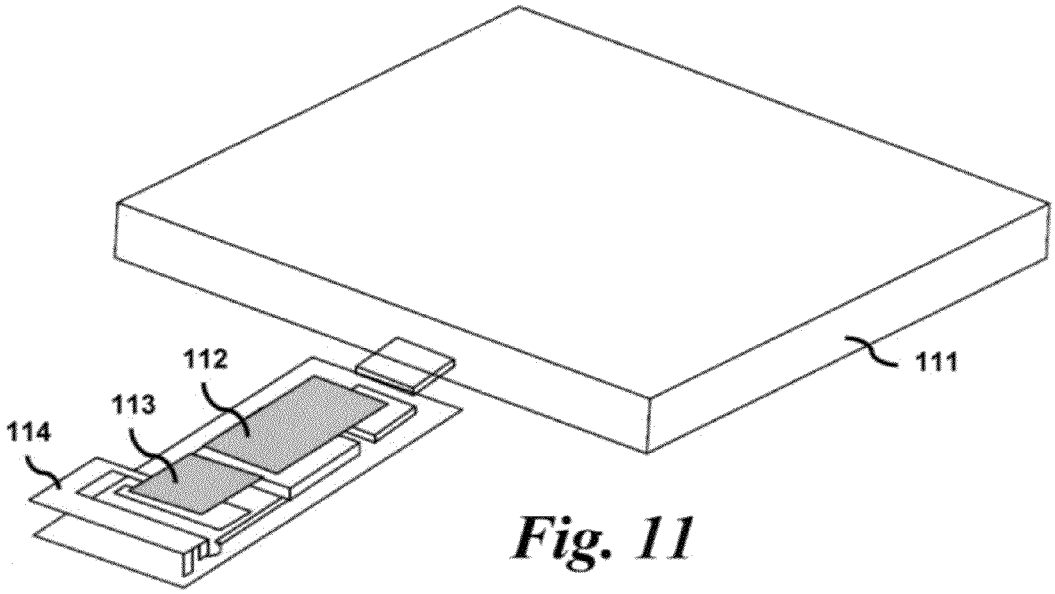
FIG. 11 illustrates an example of a wireless device with a conductive element attached to a host device such as a laptop.

FIG. 11 illustrates an example of a wireless device 114 comprising a pair of conductive elements 112; 113 in close proximity to the antenna, with the wireless device attached to a host device 111 such as a laptop. A user often couples to the antenna fields when using a radiator with a host device. Using this embodiment, antenna field characteristics can be optimized to overcome coupling from a user. FIGS. 12(*a-b*) further illustrate examples of the wireless communication device for improving these antenna field parameters.

Figure 12A:
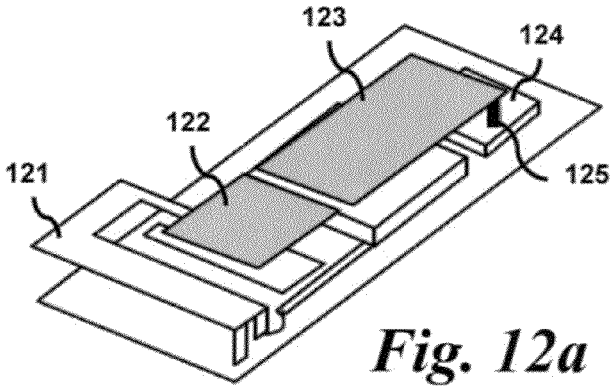
FIG. 12 illustrates a conductive element positioned in close proximity to a wireless device, where the conductive element is attached at one or more locations to a shield can, component, or ground layer of the circuit board.
Figure 12B:
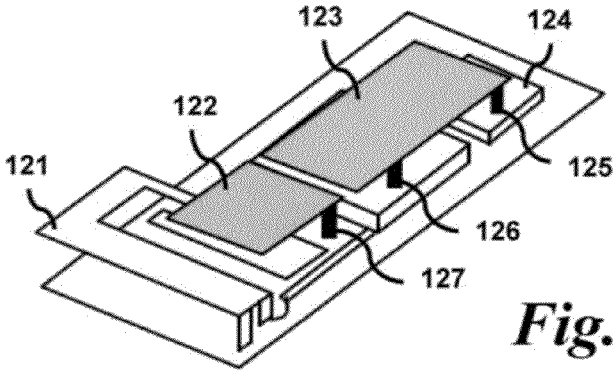

FIG. 12*a* illustrates two conductive elements, a first conductive portion 122 and a second conductive portion 123, positioned in proximity to a wireless antenna device 121. Conductive element 123 is connected to a shield can. This connection will provide a ground connection for the conductive element. In a similar embodiment as illustrated in FIG. 12*b*, conductive elements 122 and 123 are shown with multiple connections 125; 126; 127 to shield cans, components, and the ground layer of the circuit board of the wireless device, respectively.

Figure 13:
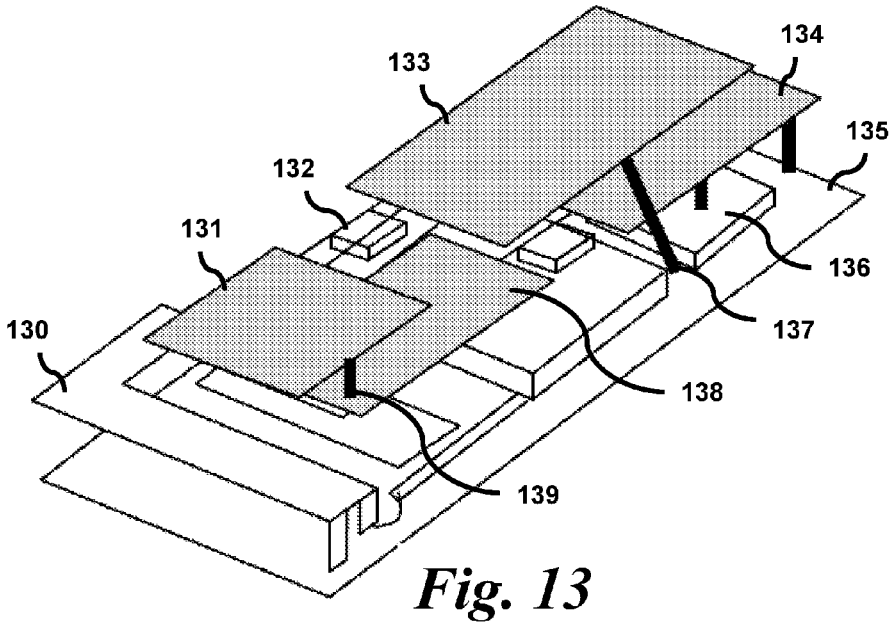
FIG. 13 illustrates two conductive elements positioned in proximity to a wireless device. One conductive element is connected to a shield can and the ground layer of the circuit board of the wireless device. The second conductive element is connected to the first conductive element and the ground layer of the wireless device.

FIG. 13 illustrates two conductive elements 131 and 138 positioned in proximity to a wireless antenna device 130. Conductive element 131 includes a first portion and second portion 133 connected by a bridge component 132. The bridge component can be an active component or a lumped component. Similarly, conductive element 138 includes a first conductive portion and a second conductive portion 134 connected by a bridge component. Conductive element 138 is connected to a shield can 136 and the ground layer 137 of the circuit board of the wireless device. Conductive element 131 is connected to conductive element 138 with connection 139 and is connected to the ground layer 137 of the wireless device.

Figure 14:
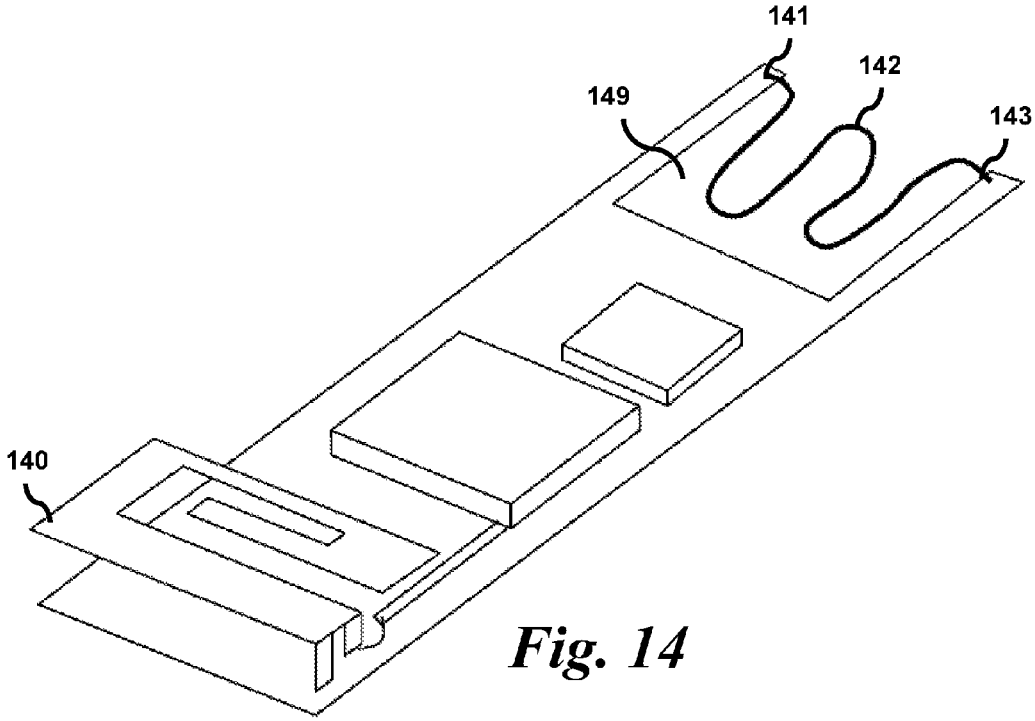
FIG. 14 illustrates a conductive element attached at two locations of the circuit board of the wireless device. The conductive element is positioned and attached to the circuit board to modify the electromagnetic field distribution in the near field.

FIG. 14 illustrates a conductive element 142 attached to a circuit board of a wireless device at a first portion 141 and a second portion 143 separated by an etched portion 149. The conductive element is positioned and attached to the circuit board to modify the electromagnetic field distribution in the near field. In this regard, the circuit board can include an etched portion 149, and the conductive element 142 can be connected across the etched portion 149.

Figure 15:
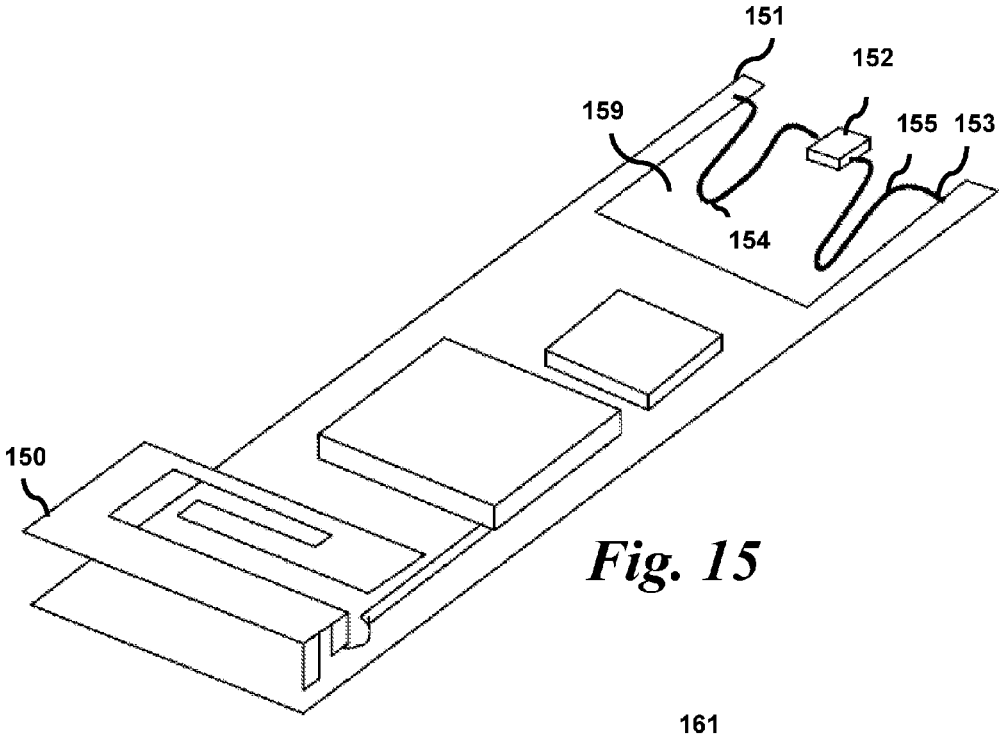
FIG. 15 illustrates two conductive elements attached at two locations of the circuit board of the wireless device with a lumped component used to connect the conductive elements. The lumped element is used to modify the frequency response of the two conductive elements.

FIG. 15 illustrates two conductive elements 154 and 155 attached to a first portion 151 and a second portion 153 of the circuit board of the wireless device with a lumped component 152 used to connect the conductive elements. The two portions 151 and 153, respectively, are separated by an etched portion 159 of the circuit board wherein a volume of the circuit board is removed to form the etched portion. The lumped element 152 is used to modify the frequency response of the two conductive elements 154 and 155. The conductive elements 154 and 155 are positioned and attached to the circuit board to modify the electromagnetic field distribution in the near field.

Figure 16:
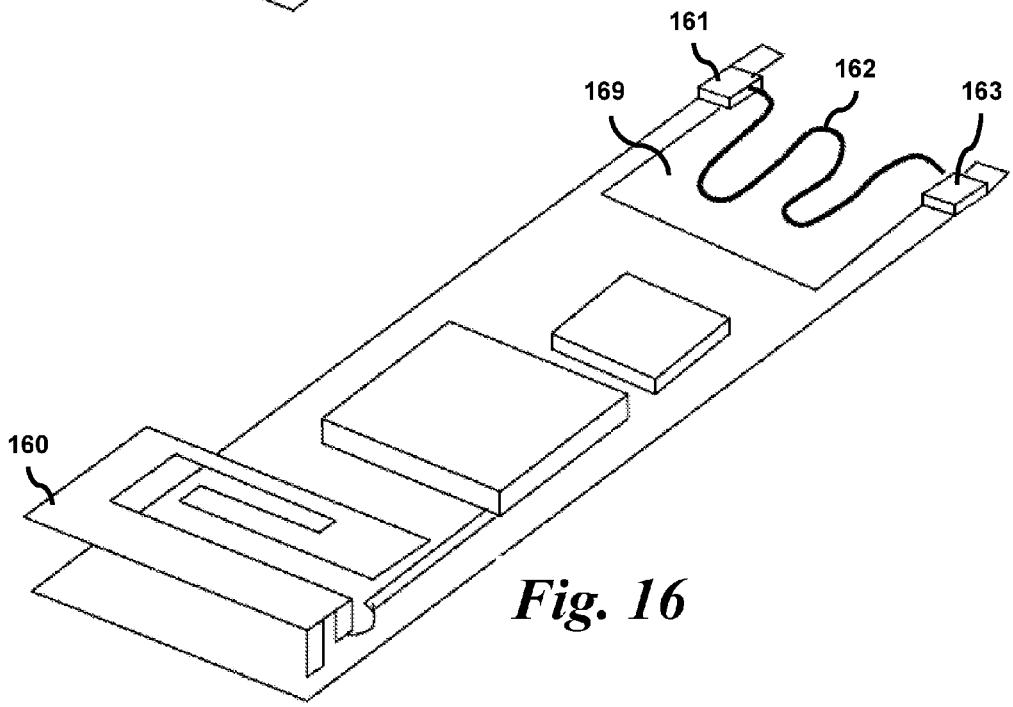
FIG. 16 illustrates a conductive element attached to two lumped components, with the lumped elements attached to the circuit board of the wireless device. The lumped elements are used to modify the frequency response of the two conductive elements.

FIG. 16 illustrates a conductive element 162 attached to two lumped components 161 and 163, with the lumped elements attached to the circuit board of the wireless device. The two lumped elements 161 and 163 are connected to the circuit board at opposing portions of the circuit board separated by an etched portion 159, wherein a volume of the circuit board is removed to form the etched portion. The lumped elements 161 and 163 are used to modify the frequency response the conductive element 162. The conductive element 162 is positioned and attached to the lumped elements 161 and 163 to modify the electromagnetic field distribution in the near field.

Figure 17:
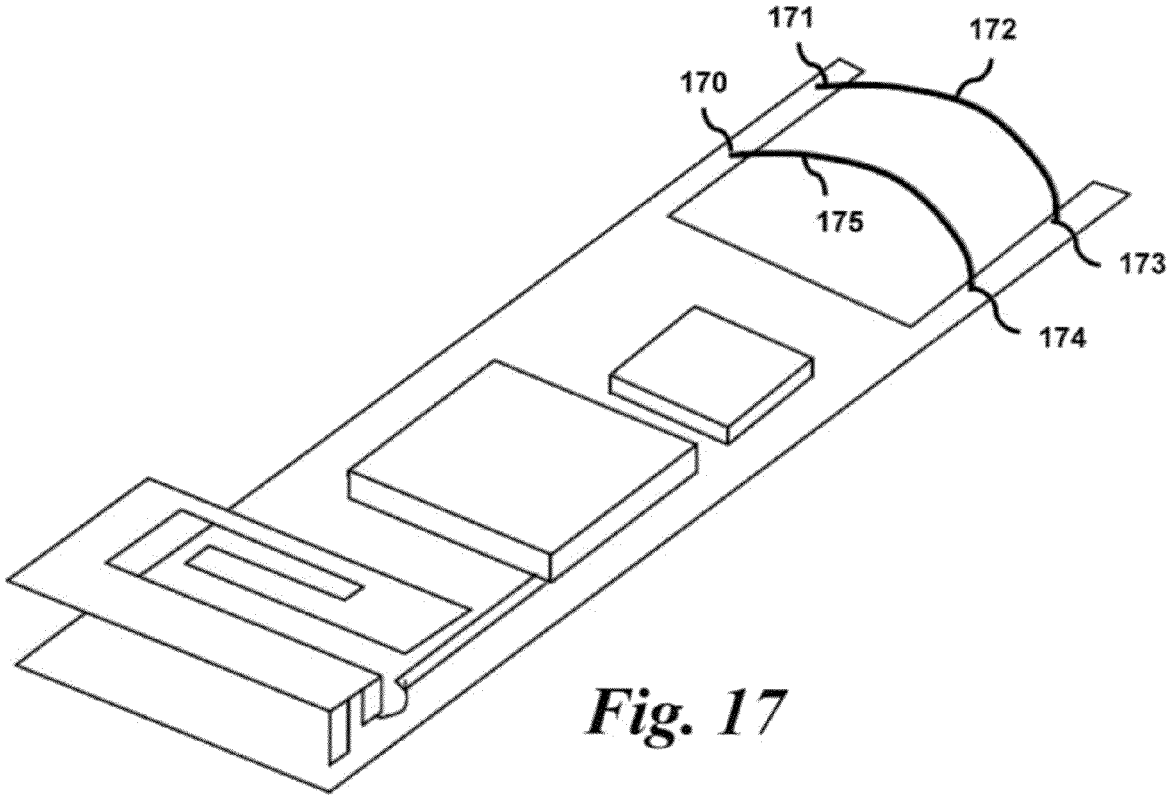
FIG. 17 illustrates two conductive elements attached to four locations of the circuit board of the wireless device. The conductive elements are positioned and attached to the circuit board to modify the electromagnetic field distribution in the near field.

FIG. 17 illustrates two conductive elements 172 and 175 attached to four locations 170, 171, 173, and 174 of the circuit board of the wireless device. The conductive elements 172 and 175 are positioned and attached to the circuit board to modify the electromagnetic field distribution in the near field.

In certain embodiments, an antenna system for use within a wireless device can comprise a circuit board having a first side and a second side disposed opposite one another about a width of the circuit board. The circuit board may further comprise a first portion extending outwardly along a length of the circuit board at the first side and a second portion extending outwardly along the length of the circuit board at the second side. In this regard, the first and second portions extend from the circuit board and are parallel with respect to one another. An etched portion is formed between the first and second portions, and comprises a volume of the circuit board which has been removed. One or more conductive elements can be coupled to the first and second portions, respectively, such that the conductive elements extend across the etched portion. One or more lumped components can be connected to the one or more conductive elements, respectively. The one or more lumped elements may be coupled to the first and/or second portions of the circuit board separated by the etched portion. An antenna element is positioned above the circuit board. In this regard, the antenna element, conductive elements, lumped components, and etched portion are adapted to modify the electromagnetic field distribution in the near field. The etched portion may also be referred to as a "void".

In the forgoing description of the invention, a number of embodiments are described, each being capable of modifying electromagnetic field characteristics in the antenna near field, without significant effect on far fields. These and similar embodiments can be used to reduce the SAR, and therefore improve antenna quality.

The above examples are set forth for illustrative purposes and are not intended to limit the spirit and scope of the invention. One having skill in the art will recognize that deviations from the aforementioned examples can be created which substantially perform the same functions and obtain similar results.

What is claimed is:

1. A wireless communications device, comprising:

a circuit board including a first portion and a second portion separated by an etched portion extending therebetween, wherein a volume of the circuit board is removed to form the etched portion;

an antenna element positioned above the circuit board; and at least one conductive element being adapted to modify a near field distribution of the antenna element during operation thereof;

said at least one conductive element extending across the etched portion of the circuit board, the conductive element having a first end coupled to the first portion of the circuit board and a second end coupled to the second portion of the circuit board.

2. The wireless device of claim 1, further comprising a lumped reactance component, said lumped reactance component connected to said conductive element for altering the field characteristics of the wireless device.

3. The wireless device of claim 2, further comprising an active component for dynamic tuning of the antenna near field characteristics, wherein at least one of the conductive elements comprises a first portion and a second portion thereof and the active component is coupled between the first and second portions of the conductive element.

4. The wireless device of claim 2, wherein the lumped reactance component is further coupled the circuit board at one of said first and second portions thereof.

5. The wireless device of claim 4, comprising two lumped reactance components, wherein each of said lumped reactance components is individually coupled to the circuit board at one of said first and second portions thereof.

6. The wireless device of claim 1, comprising two or more conductive elements, wherein each of said conductive elements comprises a first end thereof coupled to the circuit board at the first portion, and a second end thereof coupled to the circuit board at the second portion.

7. The wireless device of claim 1, wherein the conductive element comprises a distributed reactance portion and a lumped reactance portion.

8. The wireless device of claim 7, wherein the lumped reactance portion is coupled to the distributed reactance portion by an active component.

9. An antenna system for use within a wireless device, the antenna system comprising:

a circuit board including a first portion and a second portion extending outwardly therefrom, the first portion and second portion being oriented parallel with respect to one another and separated by a void disposed therebetween;

an antenna element positioned above the circuit board; and at least one conductive element being adapted to modify a near field distribution of the antenna element during operation thereof;

said at least one conductive element extending across the etched portion of the circuit board, the conductive element having a first end coupled to the first portion of the circuit board and a second end coupled to the second portion of the circuit board.

10. The antenna system of claim 9, further comprising a lumped reactance component, said lumped reactance component connected to said conductive element for altering the field characteristics of the wireless device.

11. The antenna system of claim 10, further comprising an active component for dynamic tuning of the antenna near field characteristics.

12. The antenna system of claim 10, wherein the lumped reactance component is further coupled the circuit board at one of said first and second portions thereof.

13. The antenna system of claim 12, comprising two lumped reactance components, wherein each of said lumped reactance components is individually coupled to the circuit board at one of said first and second portions thereof.

14. The antenna system of claim 9, comprising two or more conductive elements, wherein each of said conductive elements comprises a first end thereof coupled to the circuit board at the first portion, and a second end thereof coupled to the circuit board at the second portion.

15. The antenna system of claim 9, wherein at least one of said conductive elements comprises a distributed reactance portion.

* * * * *